US006351897B1

(12) United States Patent
Smith

(10) Patent No.: US 6,351,897 B1
(45) Date of Patent: Mar. 5, 2002

(54) ATHLETIC SHOE

(76) Inventor: Rudolph Smith, 355 Kendall Rd., Buellton, CA (US) 93427

( * ) Notice: Subject to any disclaimer, the term of this patent is extended or adjusted under 35 U.S.C. 154(b) by 0 days.

(21) Appl. No.: 09/605,418

(22) Filed: Jun. 27, 2000

(51) Int. Cl.[7] ..... A43C 11/00; A43B 23/26

(52) U.S. Cl. ..... 36/50.1; 36/50.5; 36/54; 36/72 R

(58) Field of Search ..... 36/50.1, 50.5, 36/71, 96, 117.9, 54, 72 R

(56) References Cited

U.S. PATENT DOCUMENTS

| | | | | | |
|---|---|---|---|---|---|
| 660,284 | A | * | 10/1900 | Webber | 36/50.1 |
| 1,215,198 | A | * | 2/1917 | Rothstein | 36/54 |
| 4,080,745 | A | * | 3/1978 | Torrance | 36/50.1 |
| 4,845,864 | A | * | 7/1989 | Corliss | 36/50.1 |
| 4,901,451 | A | * | 2/1990 | Cumin | 36/50.1 |
| 5,337,493 | A | * | 8/1994 | Hill | 36/54 |
| 5,893,210 | A | * | 11/1998 | Bernier et al. | 36/50.1 |
| 5,926,978 | A | * | 7/1999 | Smith | 36/50.1 |

* cited by examiner

*Primary Examiner*—M. D. Patterson

(74) *Attorney, Agent, or Firm*—David A. Belasco; Beehler & Pavitt

(57) ABSTRACT

The present invention provides an athletic shoe offering an easily adjustable support for the wearer's ankle, a means for the wearer to quickly put on and remove the shoe, protection to the wearer's toes and forefoot from impacts to the upper surface of the shoe, and a unique and attractive appearance. The shoe may be constructed from four basic components: a resilient sole, an ankle surrounding section, an instep enclosing section, and a toe section. The ankle surrounding section begins at the after end of the sole portion and extends forward to a point between the forward end and the after end defining an opening through which a wearer's foot is passed. The toe section extends from the forward end of the sole portion backward and runs from the inner edge to the outer edge of the sole portion. The wearer's toes are inserted into the cavity defined by the toe section. The instep enclosing section extends from the toe section to the ankle surrounding section. It is hingedly secured along the outer edge of the sole portion. The instep enclosing section is adapted to swing from a first open position, permitting introduction of the wearer's foot, to a second closed position in which its second edge abuts the inner edge of the sole portion. The invention also includes a means for detachably securing the second edge of the instep enclosing section to the abutting inner edge of the sole using tapered pins or ridged tabs and matching receptacles.

8 Claims, 7 Drawing Sheets

ATHLETIC SHOE

FIELD OF INVENTION

The present invention relates to the field of shoes and foot coverings; more particularly, to athletic shoes providing a unique entry and closure system.

BACKGROUND OF THE INVENTION

As sporting activities become more performance oriented, the demands placed on sporting equipment become more sophisticated. The technical requirements for athletic shoes used in such events have tended to evolve in lock step with the advancement of such activities. Toward this end, various designs for athletic shoes, and more particularly designs for shoe closure systems have been developed.

U.S. Pat. No. 5,557,866, issued to Prengler on Sep. 24, 1996, illustrates athletic footwear having a hinged rear entry and associated fastening system. U.S. Pat. No. 4,616,432 issued to Bunch et al. on Oct. 14, 1986 shows an athletic shoe with a lace closure disposed along the side of the shoe rather than in a central location. U.S. Pat. No. 4,811,497, issued to Ciudad on Mar. 14, 1989, describes a sport shoe incorporating a series of flexible strips on the vamp of the shoe connected together with elastic material, providing a lace-less entry system. U.S. Pat. No. 5,177,882, issued to Berger on Jan. 12, 1993 illustrates a shoe with a central fastener used to secure a rigid instep cover which is drawn to the shoe upper with a series of cables.

In addition to these various closure mechanisms, a number of patents address methods for attaching the shoe upper to the sole. U.S. Pat. No. 2,444,640, issued to Epstein on Jul. 6, 1948, describes a zipper-type closure for attaching different toe enclosing portions of the upper to the sole. A similar system is used in U.S. Pat. No. 2,200,080, issued to Fein on May 7, 1940, to attach the entire upper to the sole of the shoe. U.S. Pat. No. 3,204,346, issued to Lockard et al. on Sep. 7, 1965, illustrates a groove and matching, sliding projection system for attaching the upper to the sole portion.

It is an objective of the present invention to provide an athletic shoe offering easily adjustable support to the wearer's ankle. It is a further objective of the invention to provide a means for the wearer to quickly put on and remove the shoe. It is a still further objective of the present invention to provide protection to the wearer's toes and forefoot from impacts to the upper surface of the shoe. It is yet a further objective of the invention to provide an athletic shoe with a unique and attractive appearance. While the prior art shoes examined provide a variety of useful features, none answer the requirements of the present invention.

SUMMARY OF THE INVENTION

The athletic shoe of the present invention incorporates a number of novel features which, taken together, address all of the objectives stated above. The athletic shoe may be constructed from four basic components, a resilient sole, an ankle surrounding section, an instep enclosing section, and a toe section.

The resilient sole portion has a forward end, an after end, an inner edge and an outer edge. The ankle surrounding section begins at the after end of the sole portion and extends forward to a point between the forward end and the after end. The ankle surrounding section defines an opening through which a wearer's foot is passed.

The toe section extends from the forward end of the sole portion for a first predetermined distance and extends from the inner edge to the outer edge of the sole portion. The toe section defines a cavity into which the wearer's toes are inserted.

The instep enclosing section has an inner surface, an outer surface, a front end, a rear end, a first edge and a second edge. The instep enclosing section extends from the toe section to the ankle surrounding section. Its first edge is hingedly secured along the outer edge of the sole portion. The instep enclosing section is adapted to swing from a first open position, permitting introduction of the wearer's foot, to a second closed position in which the second edge of the instep enclosing portion abuts the inner edge of the sole portion. The invention also includes a means for detachably securing the second edge of the instep enclosing section to the abutting inner edge of the sole.

In a variant of the invention, the instep enclosing section includes at least one resilient pad. The pad is secured to the inner surface of the instep enclosing section and is sized, shaped and located to bear against the wearer's instep when the instep enclosing section is in the second, closed position.

In a further variant, the means for detachably securing the second edge of the instep enclosing section to the abutting inner edge of the sole portion further includes at least one pin. These pins are attached to the second edge of the instep enclosing section and extend downwardly from it. Each of these pins has a front side and a backside and include a notch of a predetermined size. The notch extends partially into the backside of the pin. The notch is positioned orthogonal to a long axis of the pin.

A retaining chamber is affixed to the inner edge of the sole portion adjacent the second edge of the instep enclosing section. The retaining chamber has a top surface, a bottom surface, a front end, a rear end, and an interior cavity. The rear end has an orifice penetrating it and extending to the interior cavity. The retaining chamber also has a plurality of holes extending from the top surface downwardly to the interior cavity. Each of these holes is sized and positioned to receive one of the pins.

A locking strip having a front end, a rear end, a top surface, a bottom surface, a series of locking teeth is provided. The locking strip is slidably positioned within the retaining chamber and is slidably located on the bottom surface of the retaining chamber. The locking strip is movable from a first, forward locking position to a second, rearward open position. The locking teeth are sized, shaped and located to removably engage the notches of the previously mentioned pins.

The securing means also includes a spring which is sized, shaped and located between the locking strip and the retaining chamber so as to urge the locking strip forward toward the first locking position. A guide block is provided. The guide block has a top surface and a bottom surface and is fixedly attached adjacent the after end of the sole portion. The guide block includes an orifice extending from the top surface to the bottom surface. A release cable is fixedly attached to the rear end of the locking strip and extends through the orifice in the rear end of the retaining chamber and rearwardly along the inner edge of the sole portion and upwardly through the guide block to terminate in a finger loop above the guide block.

When the release cable is pulled upwardly via the finger loop, the locking strip will move rearwardly, compressing the spring, causing the locking teeth to reversibly disengage from the notches of the pins, permitting the instep enclosing section to swing upward to allow the wearer's foot to be removed. When the wearer's foot in placed within the shoe and the instep enclosing section lowered so that the pins enter the retaining chamber and the release cable is pulled and released, the teeth of the locking strip will removably engage the notches of the pins to secure the instep enclosing section to the inner edge of the sole portion.

In a further variant of the invention, the spring that urges the locking strip forward to the first locking position is at least one coil spring located between the locking strip and the retaining chamber.

In yet another variant, the spring urging the locking strip forward to the first locking position is at least one flat spring located between the locking strip and the retaining chamber.

In a still further variant of the invention, each of the pins has an upper end and a lower end. The pins taper from the upper end to the lower end so as to control the depth to which the pins will extend into the interior cavity of the retaining chamber.

In a further variant, a series of holes extending from the top surface of the retaining chamber downwardly into the interior cavity are tapered to removably receive the pins attached to the second edge of the instep enclosing section. This taper further controls the depth to which the pins will extend into the interior cavity and thus controls the alignment of the pins with the locking teeth.

In a still another variant of the invention, each of the locking teeth have a beveled front edge to assist in alignment of the tooth with the notch in the pin.

In yet another variant of the invention, each of the notches in the pins are sized, shaped and located to removably engage the beveled front edges of the locking teeth.

In another variation on the athletic shoe invention, the means for detachably securing the second edge of the instep enclosing section to the abutting inner edge of the sole portion further includes at least one fastening tab. The fastening tab has a connecting portion and an attachment portion. The connecting portion has an upper end and a lower end. The attachment portion has a first end, a second end, a first predetermined width, a first predetermined thickness, and a front surface. The front surface includes a ridged section and at least one tensioning section. The fastening tab is fixedly attached at the upper end of the connecting portion to the second edge of the instep enclosing section. The attachment portion is fixedly attached at its first end to the lower end of the connecting portion. The ridged section includes at least one ridge extending outward from the front surface. The tensioning section is coplanar with the ridged section at the first end of the attachment portion and displaced from the ridged section at the second end of the attachment portion.

At least one retaining socket is provided. The retaining socket has an open top, a bottom, a first side, a second side, a front surface, an internal cavity and an orifice. The orifice penetrates the front surface to the internal cavity. The orifice has a rectilinear upper edge. The upper edge is sized, shaped and located to removably engage the ridge of the ridged section of the attachment portion of the fastening tab. The retaining socket is fixedly attached adjacent the inner edge of the sole portion. It is sized, shaped and located to permit entry of the attachment portion of the fastening tab.

When the instep enclosing section is moved toward the second, closed position, the attachment portion of the fastening tab will enter the open top of the retaining socket and the tensioning section will be urged toward the ridged section as the fastening tab is lowered. The ridge will slide past the rectilinear upper edge of the orifice and be retained by the edge, thereby closing the instep enclosing section over the wearer's foot. When the ridged section is pushed inward toward the sole portion and upward pressure is provided by the wearer's foot against the instep enclosing section, the ridge will pass the rectilinear edge and the attachment portion of the fastening tab will slide upward, allowing the instep enclosing section to pivot upward, allowing the wearer's foot to be removed from the shoe.

In a further variant, the ridged section of the attachment portion of the fastening tab includes at least two ridges extending outwardly from the front surface. This provides a means for adjustably securing the instep enclosing section over the wearer's foot.

In another variation, the means for detachably securing the second edge of the instep enclosing section to the abutting inner edge of the sole portion further includes a cover. The cover is sized, shaped and located to enclose the front surface of the retaining socket while protecting the rectilinear edge of the orifice from dirt and foreign matter. The cover includes an opening permitting pressure to be applied to the ridged section of the attachment portion of the fastening tab to affect release of the fastening tab from the retaining socket.

In yet another variant, the athletic shoe includes a resilient sole portion having a forward end, an after end, an inner edge, an outer edge. An ankle surrounding section arises from the after end of the sole portion and extends forward to a point intermediate of the forward end and the after end. The ankle surrounding section defines an opening through which a wearer's foot is passed.

A toe section is provided. The toe section extends from the forward end of the sole portion for a first predetermined distance from the inner edge to the outer edge of the sole portion, defining a cavity into which the wearer's toes are inserted.

An instep enclosing section is provided. The instep enclosing section has an inner surface, an outer surface, a front end, a rear end, a first edge and a second edge. The instep enclosing section extends from the toe section to the ankle surrounding section. The first edge is hingedly and detachably secured along the outer edge of the sole portion. The instep enclosing section is adapted to swing from a first open position, permitting introduction of the wearer's foot, to a second closed position in which the second edge of the instep enclosing portion abuts the inner edge of the sole portion.

A means for detachably securing the second edge of the instep enclosing section to the abutting outer edge of the sole is provided. When the instep enclosing section is located in the first open position, and the first edge is detached from the outer edge of the sole portion, the instep enclosing section is removed from the shoe.

DETAILED DESCRIPTION OF THE PREFERRED EMBODIMENT

Figure 1:
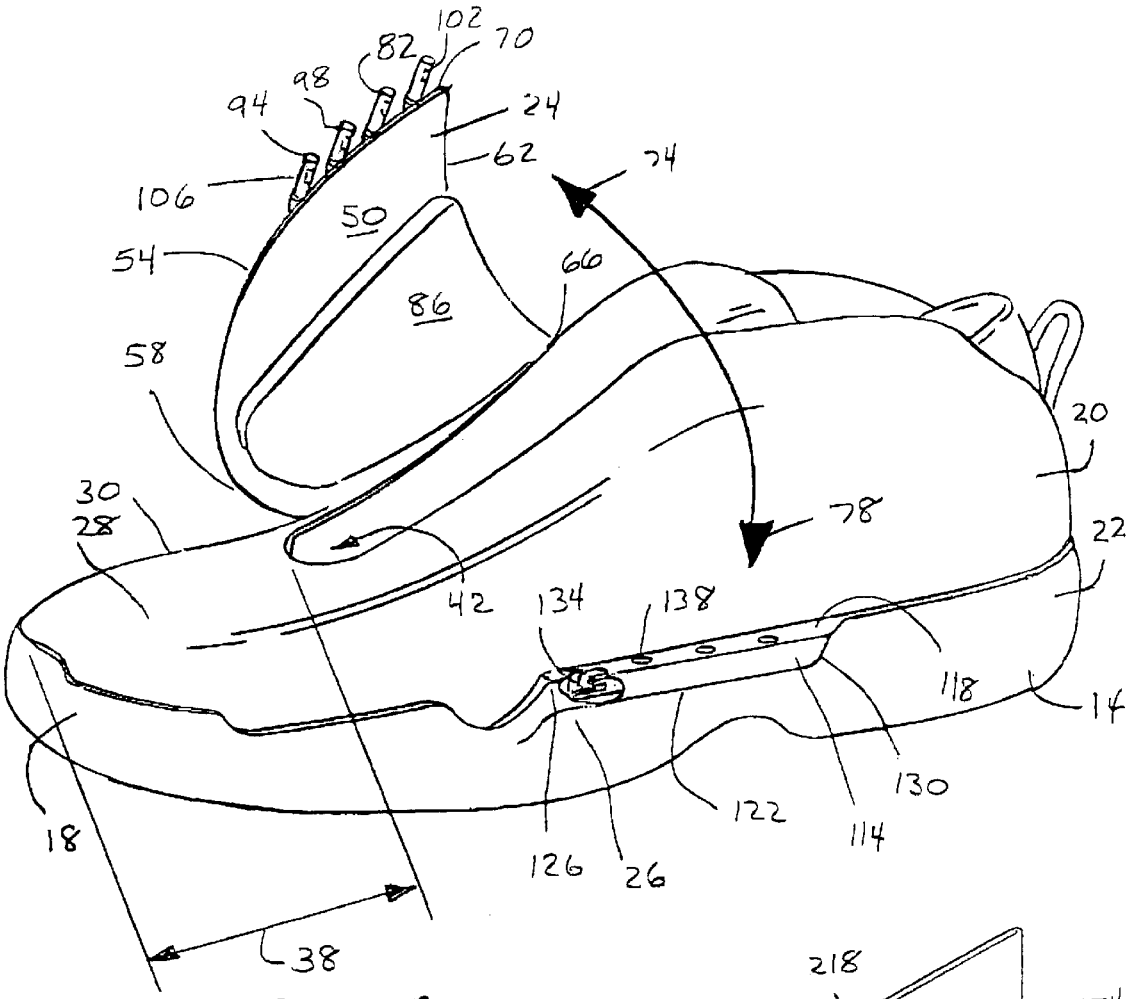
FIG. 1 is a perspective view of the athletic shoe of the present invention.
Figure 6:
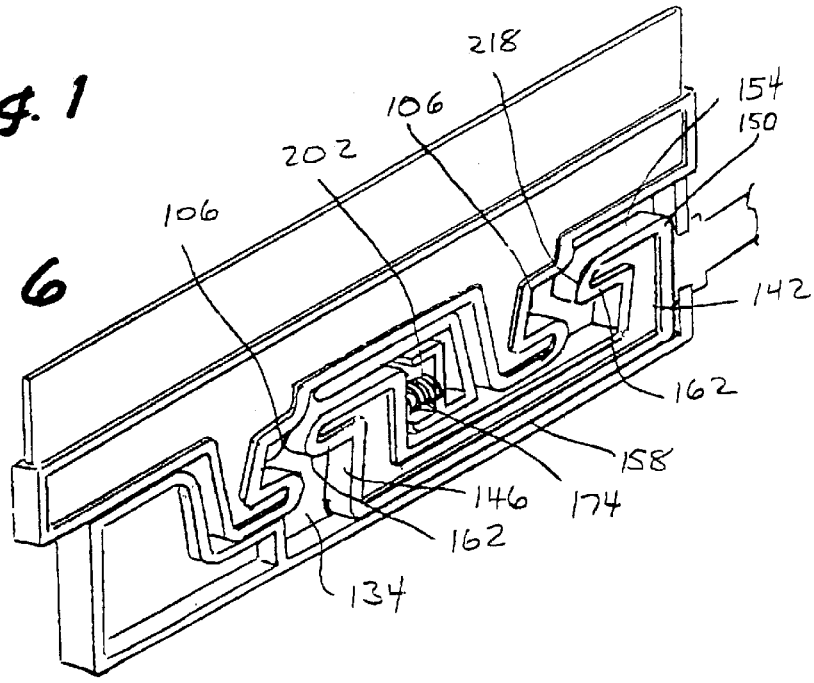
FIG. 6 is a closeup perspective of the pins, locking teeth and locking strip of the FIG. 4 embodiment.

As illustrated in FIGS. 1–15, the athletic shoe 10 of the present invention incorporates a number of novel features which, taken together, address all of the objectives stated above. The athletic shoe 10, as illustrated in FIG. 1, may be constructed from four basic components, a resilient sole 14, an ankle surrounding section 20, an instep enclosing section 24, and a toe section 28.

The resilient sole portion 14 has a forward end 18, an after end 22, an inner edge 26 and an outer edge 30. The ankle surrounding section 20 begins at the after end 22 of the sole portion 14 and extends forward to a point between the forward end 18 and the after end 22. The ankle surrounding section 20 defines an opening through which a wearer's foot (not shown) is passed.

The toe section 28 extends from the forward end 18 of the sole portion 14 for a first predetermined distance 38 and extends from the inner edge 26 to the outer edge 30 of the sole portion 14. The toe section 28 defines a cavity 42 into which the wearer's toes (not shown) are inserted.

The instep enclosing section 24 has an inner surface 50, an outer surface 54, a front end 58, a rear end 62, a first edge 66 and a second edge 70. The instep enclosing section 24 extends from the toe section 28 to the ankle surrounding section 20. Its first edge 66 is hingedly secured 72 along the outer edge 30 of the sole portion 14. The instep enclosing section 24 is adapted to swing from a first open position 74, permitting introduction of the wearer's foot 34, to a second closed position 78 in which the second edge 70 of the instep enclosing section 24 abuts the inner edge 26 of the sole portion 14. The invention also includes a means 82 for detachably securing the second edge 70 of the instep enclosing section 24 to the abutting inner edge 26 of the sole 14.

In a variant of the invention, the instep enclosing section 24 includes at least one resilient pad 86. The pad 86 is secured to the inner surface 50 of the instep enclosing section 24 and is sized, shaped and located to bear against the wearer's instep (not shown) when the instep enclosing section 24 is in the second, closed position 78.

In a further variant, the means for detachably securing the second edge 70 of the instep enclosing section 24 to the abutting inner edge 26 of the sole portion 14 further includes at least one of pin 94. These pins 94 are attached to the second edge 70 of the instep enclosing section 24 and extend downwardly from it. Each of these pins 94 has a front side 98 and a backside 102 and include a notch 106 of a predetermined size. The notch 106 extends partially into the backside of the pin 94. The notch 106 is positioned orthogonal to a long axis of the pin 94.

Figure 2:
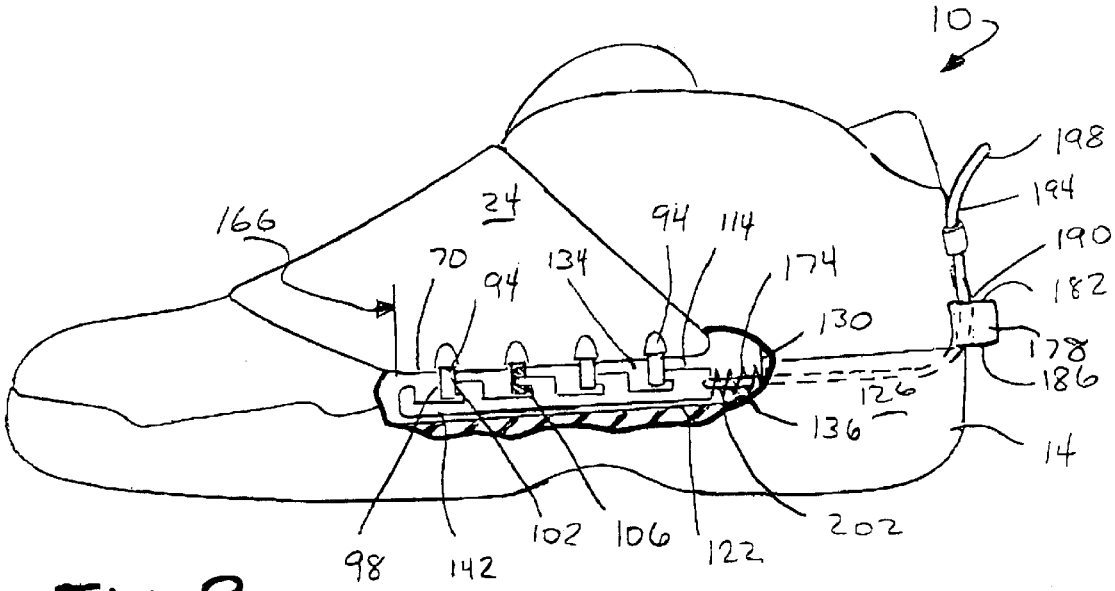
FIG. 2 is a partial cutaway side view of the FIG. 1 embodiment illustrating the engagement of the pins by the locking teeth of the locking strip.
Figure 3:
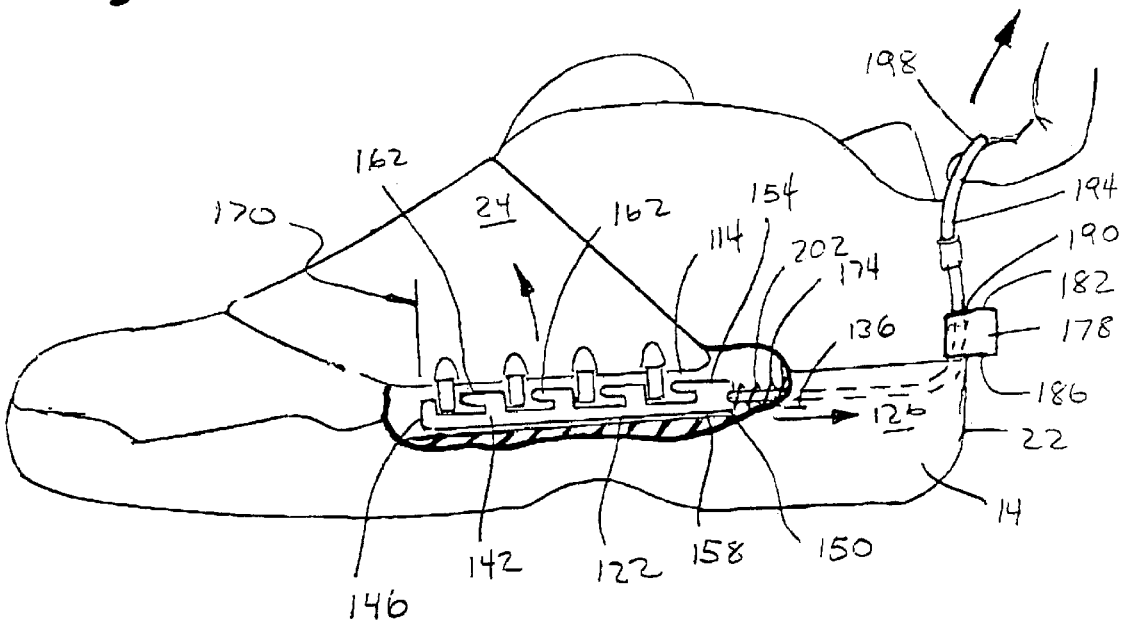
FIG. 3 is a partial cutaway side view of the FIG. 1 embodiment illustrating the disengagement of the pins from the locking teeth of the locking strip.
Figure 4:
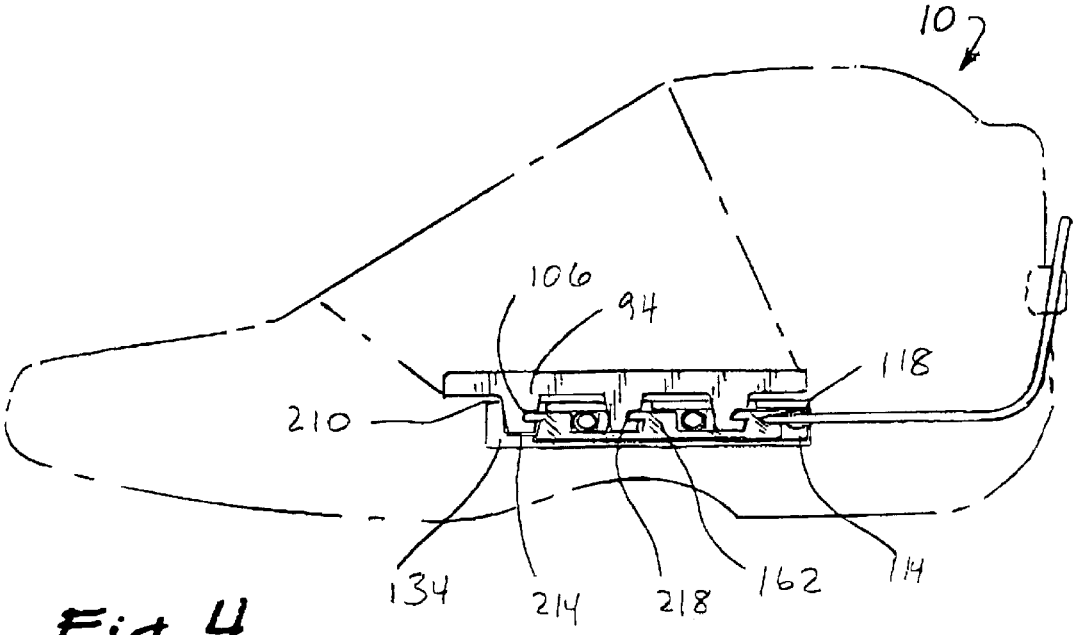
FIG. 4 is a partial cutaway side view of a second embodiment illustrating the engagement of the pins by the locking teeth of the locking strip.
Figure 5:
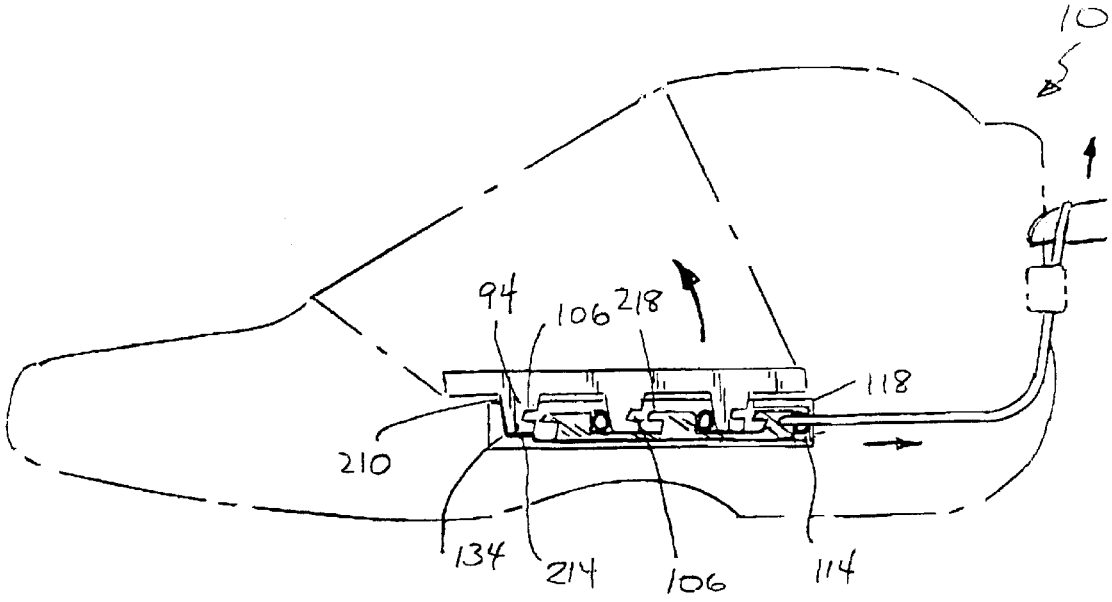
FIG. 5 is a partial cutaway side view of the second embodiment illustrating the disengagement of the pins from the locking teeth of the locking strip.
Figure 7:
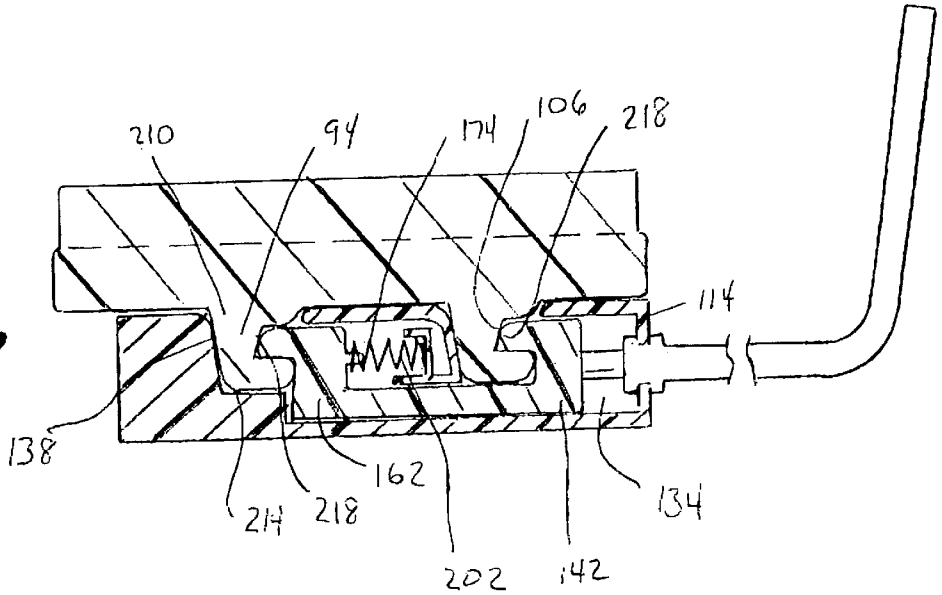
FIG. 7 is a side view cutaway view illustrating the engagement of the pins by the locking teeth of the locking strip of the FIG. 4 embodiment.
Figure 8:
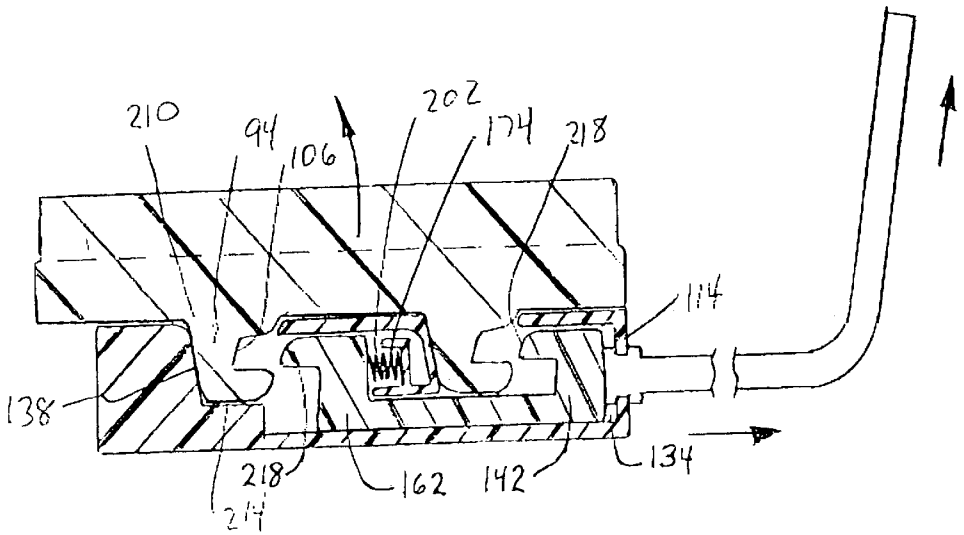
FIG. 8 is a side view cutaway view illustrating the disengagement of the pins from the locking teeth of the locking strip of the FIG. 4 embodiment.

As illustrated in FIGS. 1–3, a retaining chamber 114 is affixed to the inner edge of the sole portion 14 adjacent the second edge 70 of the instep enclosing section 24. The retaining chamber 114 has a top surface 118, a bottom surface 122, a front end 126, a rear end 130, and an interior cavity 134. The rear end 130 has an orifice 136 penetrating it and extending to the interior cavity 134. The retaining chamber 114 also has a series of holes 138 extending from the top surface 118 downwardly to the interior cavity 134. Each of these holes 138 is sized and positioned to receive one of the pins 94.

A locking strip 142 having a front end 146, a rear end 150, a top surface 154, a bottom surface 158, a series of locking teeth is provided 162. The locking strip 142 is slidably positioned within the retaining chamber 114 and is slidably located on the bottom surface 122 of the retaining chamber 114. The locking strip 142 is movable from a first, forward locking position 166 to a second, rearward open position 170. The locking teeth 162 are sized, shaped and located to removably engage the notches 106 of the previously mentioned pins 94.

The securing means 82 also includes a spring 174 which is sized, shaped and located between the locking strip 142 and the retaining chamber 114 so as to urge the locking strip 142 forward toward the first locking position 166. A guide block 178 is provided. The guide block 178 has a top surface 182 and a bottom surface 186 and is fixedly attached adjacent the after end 22 of the sole portion 14. The guide block 178 includes an orifice 190 extending from the top surface 182 to the bottom surface 186. A release cable 194 is fixedly attached to the rear end 150 of the locking strip 142 and extends through the orifice 136 in the rear end 130 of the retaining chamber 114 and rearwardly along the inner edge 26 of the sole portion 14 and upwardly through the guide block 178 to terminate in a finger loop 198 above the guide block 178.

When the release cable 194 is pulled upward via the finger loop 198, the locking strip 142 will move rearward, compressing the spring 174, causing the locking teeth 162 to reversibly disengage from the notches 106 of the pins 94, permitting the instep enclosing section 24 to swing upward to allow the wearer's foot 34 to be removed. When the wearer's foot 34 in placed within the shoe 10 and the instep enclosing section 24 lowered so that the pins 94 enter the retaining chamber 114 and the release cable 194 is pulled and released, the teeth 162 of the locking strip 142 will removably engage the notches 106 of the pins 94 to secure the instep enclosing section 24 to the inner edge 26 of the sole portion 14.

In a further variant of the invention, as illustrated in FIGS. 4–8, the spring 174 that urges the locking strip 142 forward to the first locking position 166 is at least one coil spring 202 located between the locking strip 142 and the retaining chamber 114.

In yet another variant, the spring 174 urging the locking strip 142 forward to the first locking position is at least one flat spring 206 located between the locking strip 142 and the retaining chamber 114.

In a still further variant of the invention, each of the pins 94 has an upper end 210 and a lower end 214. The pins 94 taper from the upper end 210 to the lower end 214 so as to control the depth to which the pins 94 will extend into the interior cavity 134 of the retaining chamber 114.

In a further variant, a series of holes 138 extending from the top surface 118 of the retaining chamber 114 downwardly into the interior cavity 134 are tapered to removably receive the pins 94 attached to the second edge 70 of the instep enclosing section 24. This taper further controls the depth to which the pins 94 will extend into the interior cavity 134 and thus controls the alignment of the pins 94 with the locking teeth 162.

In a still another variant of the invention, each of the locking teeth 162 have a beveled front edge 218 to assist in alignment of the tooth 162 with the notch 106 in the pin 94.

In yet another variant of the invention, each of the notches 106 in the pins 94 are sized, shaped and located to removably engage the beveled front edges 218 of the locking teeth 162.

Figure 12:
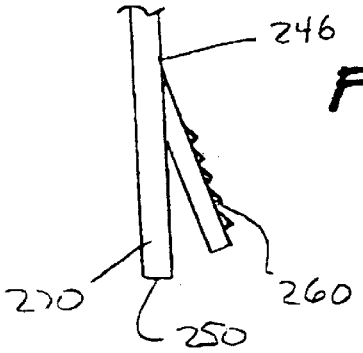
FIG. 12 is a side view detail of the fastening tab.
Figure 13:
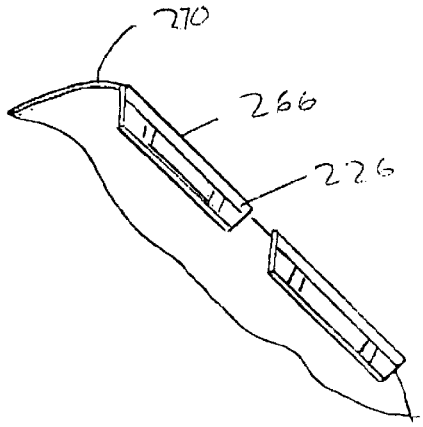
FIG. 13 is a perspective detail of a pair of fastening tabs.

In another variation on the athletic shoe invention, illustrated in FIGS. 9–14, the means 82 for detachably securing the second edge 70 of the instep enclosing section 24 to the abutting inner edge 26 of the sole portion 14 further includes at least one fastening tab 226. The fastening tab 226 has a connecting portion 230 and an attachment portion 234. The connecting portion 230 has an upper end 238 and a lower end 242. The attachment portion 234 has a first end 246, a second end 250, a first predetermined width 254, a first predetermined thickness 258, and a front surface 262. The front surface 262 includes a ridged section 266 and at least one tensioning section 270. The fastening tab 226 is fixedly attached at the upper end 238 of the connecting portion 230 to the second edge 70 of the instep enclosing section 24. The attachment portion 234 is fixedly attached at its first end 246 to the lower end 242 of the connecting portion 230. The ridged section 266 includes at least one ridge 274 extending outward from the front surface 262. As illustrated in FIG. 12, the tensioning section 270 is coplanar with the ridged section 266 at the first end 246 of the attachment portion 234 and displaced from the ridged section 266 at the second end 250 of the attachment portion 234.

Figure 9:
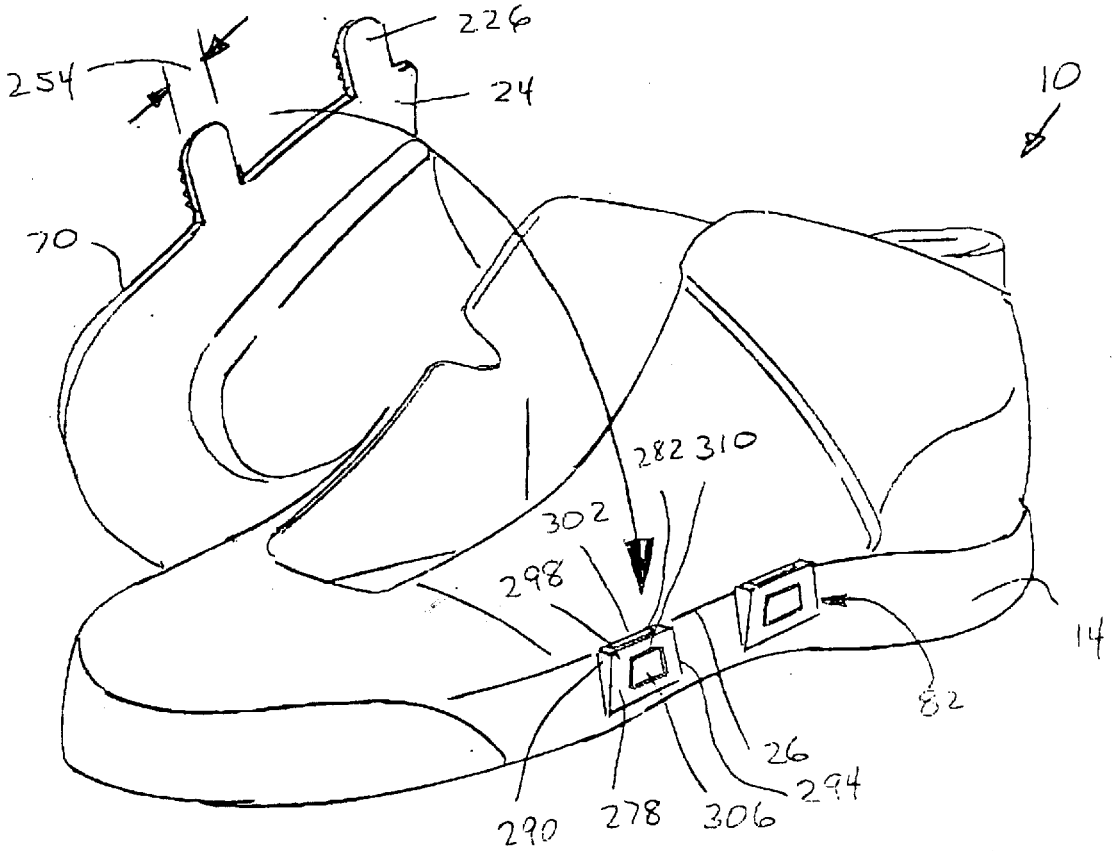
FIG. 9 is perspective view of a third embodiment of the invention illustrating an alternative closure means employing fastening tabs and retaining sockets.
Figure 10:
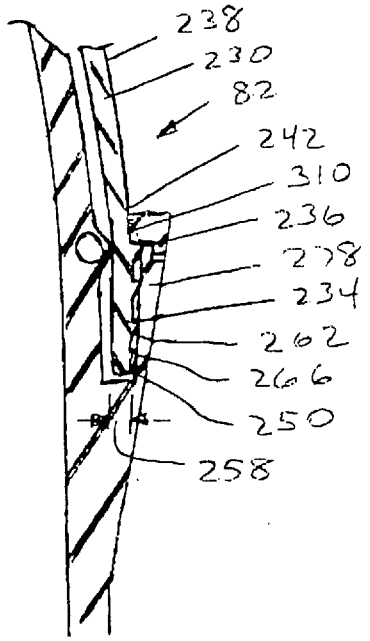
FIG. 10 is a cross-sectional detail of the fastening tab and retaining socket.
Figure 11:
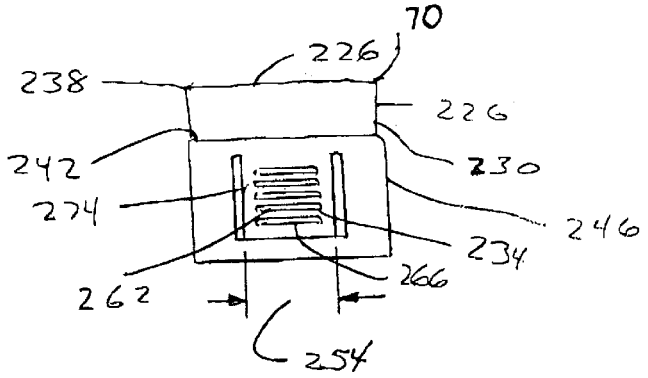
FIG. 11 is a front view detail of the retaining tab illustrating the ridged section and the tensioning section of the fastening tab.

As illustrated in FIGS. 9 and 10, at least one retaining socket 278 is provided. The retaining socket 278 has an open top 282, a bottom 286, a first side 290, a second side 294, a front surface 298, an internal cavity 302 and an orifice 306. The orifice 306 penetrates the front surface 298 to the internal cavity 302. The orifice 306 has a rectilinear upper edge 310. The upper edge 310 is sized, shaped and located to removably engage the ridge 274 of the ridged section 266 of the attachment portion 234 of the fastening tab 226. The retaining socket 278 is fixedly attached adjacent the inner edge 26 of the sole portion 14. It is sized, shaped and located to permit entry of the attachment portion 234 of the fastening tab 226.

When the instep enclosing section 24 is moved toward the second, closed position 78, the attachment portion 234 of the fastening tab 226 will enter the open top 282 of the retaining socket 278 and the tensioning section 270 will be urged toward the ridged section 266 as the fastening tab 226 is lowered. The ridge 274 will slide past the rectilinear upper edge 310 of the orifice 306 and be retained by the edge 310, thereby closing the instep enclosing section 24 over the wearer's foot. When the ridged section 266 is pushed inward toward the sole portion 14 and upward pressure is provided by the wearer's foot 34 against the instep enclosing section 24, the ridge 274 will pass the rectilinear edge 310 and the attachment portion 234 of the fastening tab 226 will slide upward, allowing the instep enclosing section 24 to pivot upward, allowing the wearer's foot 34 to be removed from the shoe 10.

In a further variant, the ridged section 266 of the attachment portion 234 of the fastening tab 226 includes at least two ridges 274 extending outwardly from the front surface 262. This provides a means for adjustably securing the instep enclosing section 24 over the wearer's foot 34.

Figure 14:
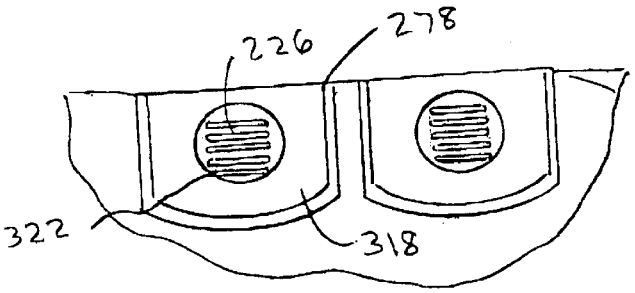
FIG. 14 is a front view detail of the retaining socket and cover.

In another variation, as illustrated in FIG. 14, the means 82 for detachably securing the second edge 70 of the instep enclosing section 24 to the abutting inner edge 26 of the sole portion 14 further includes a cover 318. The cover 318 is sized, shaped and located to enclose the front surface 298 of the retaining socket 278 while protecting the rectilinear edge 310 of the orifice 306 from dirt and foreign matter. The cover 318 includes an opening 322 permitting pressure to be applied to the ridged section 266 of the attachment portion 234 of the fastening tab 226 to affect release of the fastening tab 226 from the retaining socket 278.

Figure 15:
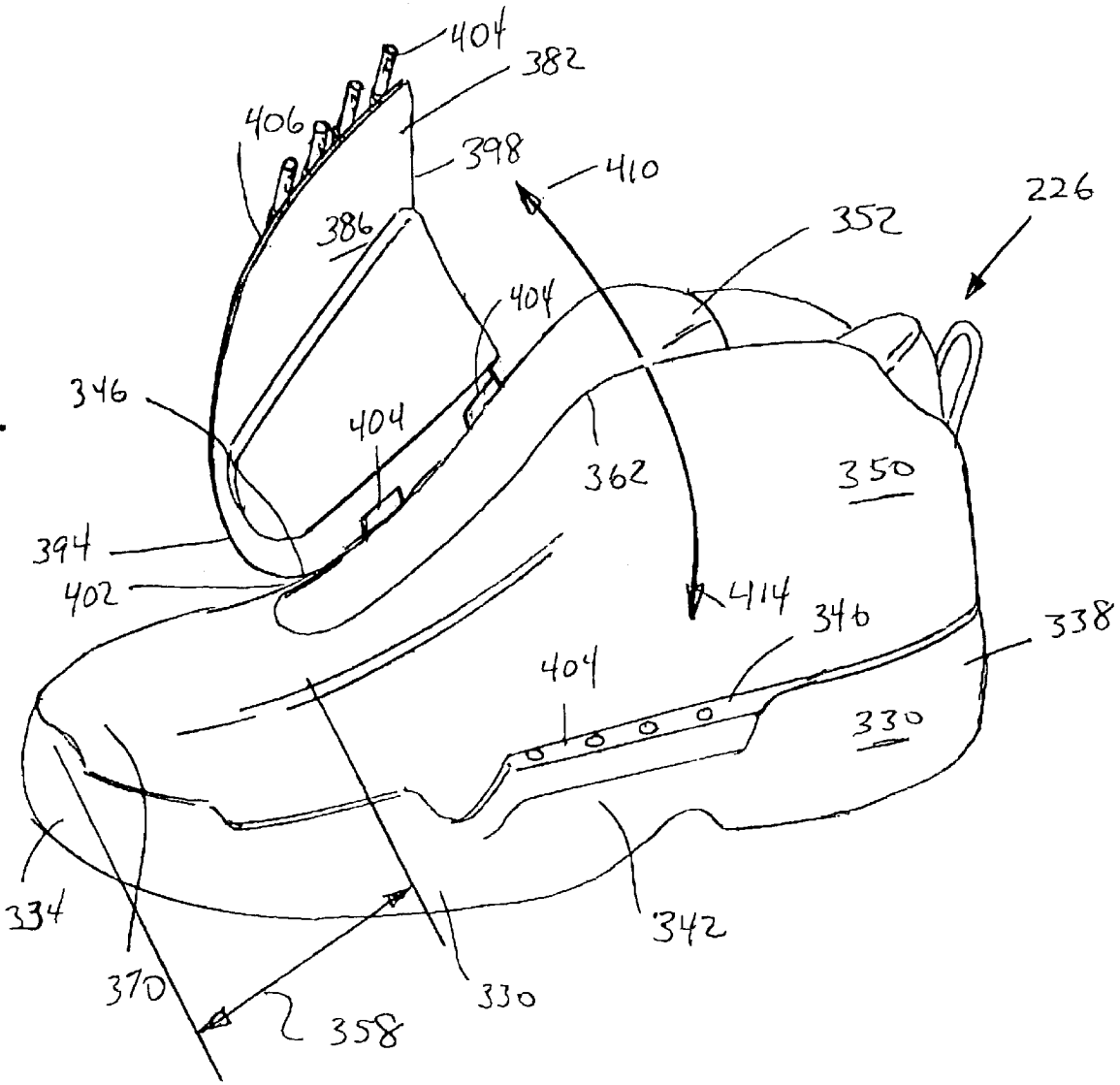
FIG. 15 is a perspective view of a fourth embodiment of the invention including a removable instep enclosing section.

In yet another variant, as illustrated in FIG. 15, the athletic shoe 226 includes a resilient sole portion 330 having a forward end 334, an after end 338, an inner edge 342, an outer edge 346. An ankle surrounding section 350 arises from the after end 338 of the sole portion 330 and extends forward to a point 362 intermediate of the forward end 334 and the after end 338. The ankle surrounding section 350 defines an opening 352 through which a wearer's foot (not shown) is passed.

A toe section 370 is provided. The toe section 370 extends from the forward end 334 of the sole portion 330 for a first predetermined distance 358 from the inner edge 342 to the outer edge 346 of the sole portion 330, defining a cavity 374 into which a wearer's toes (not shown) are inserted.

An instep enclosing section 382 is provided. The instep enclosing section 382 has an inner surface 386, an outer surface 390, a front end 394, a rear end 398, a first edge 402 and a second edge 406. The instep enclosing section extends 382 from the toe section 370 to the ankle surrounding section 350. The first edge 402 is hingedly and detachably secured along the outer edge 346 of the sole portion 330. The instep enclosing section 382 is adapted to swing from a first open position 410, permitting introduction of the wearer's foot 366, to a second closed position 414 in which the second edge 406 of the instep enclosing portion 382 abuts the inner edge 342 of the sole portion 330.

A means 404 for detachably securing the second edge 406 of the instep enclosing section 382 to the abutting outer edge 346 of the sole 330 is provided. When the instep enclosing section 382 is located in the first open position 410, and the first edge 402 is detached from the outer edge 346 of the sole portion 330, the instep enclosing section 382 is removed from the shoe 226.

What is claimed is:

1. An athletic shoe comprising:

a resilient sole portion having a forward end, an after end, an inner edge and an outer edge;

an ankle surrounding section arising from the after end of the sole portion and extending forwardly to a point intermediate of the forward end and the after end;

said ankle surrounding section defining an opening through which a wearer's foot is passed;

a toe section, said toe section extending from the forward end of the sole portion for a first predetermined distance and extending from the inner edge to the outer edge of the sole portion, and defining a cavity into which the wearer's toes are inserted;

an instep enclosing section, said instep enclosing section having an inner surface, an outer surface, a front end, a rear end, a first edge and a second edge;

said instep enclosing section extending from the toe section to the ankle surrounding section;

said first edge being hingedly secured along the outer edge of the sole portion;

said instep enclosing section being adapted to swing from a first open position, permitting introduction of the wearer's foot, to a second closed position wherein the second edge of the instep enclosing portion abuts the inner edge of the sole portion;

means for detachably securing the second edge of the instep enclosing section to the abutting inner edge of the sole, comprising:

at least one pin, said pins being attached to the second edge of the instep enclosing section and extending downwardly therefrom;

each of said pins having a front side and a back side and including a notch of a predetermined size, said notch extending partially into the back side of said pin;

said notch being positioned orthogonal to a long axis of said pin;

a retaining chamber affixed to the inner edge of the sole portion adjacent the second edge of the instep enclosing section;

said retaining chamber having a top surface, a bottom surface, a front end, a rear end, an interior cavity, an orifice penetrating said rear end and extending to said interior cavity, and having a plurality of holes extending from said top surface downwardly to said cavity, each of said holes being sized and positioned to receive one of the pins;

a locking strip, said locking strip having a front end, a rear end, a top surface, a bottom surface, a plurality of locking teeth and being slidably positioned within the retaining chamber and being slidably disposed upon the bottom surface of said chamber and movable from a first forward locking position to a second rearward open position;

said locking teeth being sized, shaped and disposed to removably engage the notches of said pins;

at least one spring, said spring being sized, shaped and disposed between the locking strip and the retaining chamber so as to urge the locking strip forward toward the first locking position;

a guide block, said guide block having a top surface and a bottom surface and being fixedly attached adjacent the after end of the sole portion and including an orifice extending from said top surface to said bottom surface;

a release cable, said cable being fixedly attached to the rear end of the locking strip and extending through the orifice in the rear end of the retaining chamber and rearwardly along the inner edge of the sole portion and upwardly through the guide block, and terminating in a finger loop above the guide block; and whereby, when the release cable is pulled upwardly by the finger loop, the locking strip will move rearwardly, compressing the spring, causing the locking teeth to reversibly disengage from the notches of the pins, thereby permitting the instep enclosing section to swing upwardly to allow the wearer's foot to be removed and when the wearer's foot in placed within the shoe and the instep enclosing section lowered so that the pins enter the retaining chamber and the release cable is pulled and released, the teeth of the locking strip will removably engage the notches of the pins to secure the instep enclosing section to the inner edge of the sole portion.

2. An athletic shoe as described in claim 1, wherein the instep enclosing section further comprises at least one resilient pad, said pad being secured to the inner surface of the instep enclosing section and being sized, shaped and disposed to bear against wearer's instep when the instep enclosing section is in the second closed position.

3. An athletic shoe as described in claim 1, wherein the spring urging the locking strip forwardly to the first locking position is at least one coil spring disposed between the locking strip and the retaining chamber.

4. An athletic shoe as described in claim 1, wherein the spring urging the locking strip forwardly to the first locking position is at least one flat spring disposed between the locking strip and the retaining chamber.

5. An athletic shoe as described in claim 1, wherein each of the pins has an upper end and a lower end and the pins taper from the upper end to the lower end so as to control the depth to which the pins will extend into the interior cavity of the retaining chamber.

6. An athletic shoe as described in claim 5, wherein the plurality of holes extending from the top surface of the retaining chamber and extending downwardly into the interior cavity are tapered to removably receive the pins attached to the second edge of the instep enclosing section, thereby further controlling the depth to which the pins will extend into the interior cavity and thus controlling the alignment of the pins with the locking teeth.

7. An athletic shoe as described in claim 1, wherein each of the locking teeth have a beveled front edge to assist in alignment of the tooth with the notch in the pin.

8. An athletic shoe as described in claim 7 wherein each of the notches in the pins is sized, shaped and disposed to removably engage the beveled front edges of the locking teeth.

* * * * *